United States Patent [19]

Craig

[11] Patent Number: 5,013,085

[45] Date of Patent: May 7, 1991

[54] LOUNGE CHAIR CANOPY CONSTRUCTION

[76] Inventor: John R. Craig, Rte. 6, Box 618, Albemarle, N.C. 28001

[21] Appl. No.: 439,161

[22] Filed: Nov. 20, 1989

[51] Int. Cl.[5] ..... A47C 7/10

[52] U.S. Cl. ..... 297/184; 135/90; 403/97; 248/229

[58] Field of Search ..... 297/184, 408; 135/117, 135/95, 96, 90, 900; 403/97, 55, 59; 248/285, 286, 229, 219.4, 291, 289.1

[56] References Cited

U.S. PATENT DOCUMENTS

| | | | |
|---|---|---|---|
| 369,971 | 9/1887 | Stillman | 248/286 |
| 1,631,831 | 6/1927 | Palmer-Jones | 403/97 |
| 1,706,215 | 3/1929 | Davidson | 403/97 |
| 2,752,929 | 7/1956 | Berger | 297/184 |
| 3,050,280 | 8/1962 | Regan | 135/90 |
| 3,148,851 | 9/1964 | Condon | 248/229 |
| 3,237,899 | 3/1966 | Lewis | 248/229 |
| 3,635,231 | 1/1972 | Bernardi | 135/90 |
| 4,201,416 | 5/1980 | Vanderminden | 297/184 |
| 4,230,363 | 10/1980 | Borichevsky | 297/184 |
| 4,300,798 | 11/1981 | Musgrove et al. | 297/184 |
| 4,547,092 | 10/1985 | Vetter et al. | 248/296 |
| 4,635,667 | 1/1987 | Harn | 297/184 |
| 4,687,249 | 8/1987 | Mills | 297/184 |
| 4,754,987 | 7/1988 | Williams | 297/184 |
| 4,865,381 | 9/1989 | Van Rogue | 297/184 |
| 4,883,315 | 11/1989 | Ferguson | 297/184 |

*Primary Examiner*—James R. Brittain
*Assistant Examiner*—Brian K. Green
*Attorney, Agent, or Firm*—Leon Gilden

[57] ABSTRACT

A canopy construction in combination with a lounge chair is set forth providing an adjustment clamp secured to the chair framework and the canopy framework to enable rotational and vertical adjustment of the canopy relative to the lounge chair framework. The canopy includes a polarized visor utilizing various opaque coverings thereover, or alternatively may utilize a first visor fixedly mounted within an annular framework with an overlying second polarized visor rotatably mounted thereto to adjust the degree of shading afforded by the overlying visor construction.

3 Claims, 4 Drawing Sheets

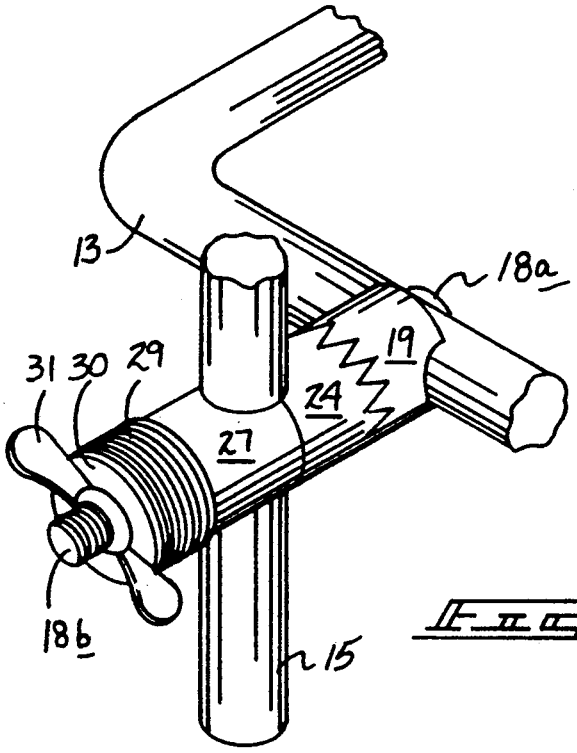
FIG 3
FIG 4
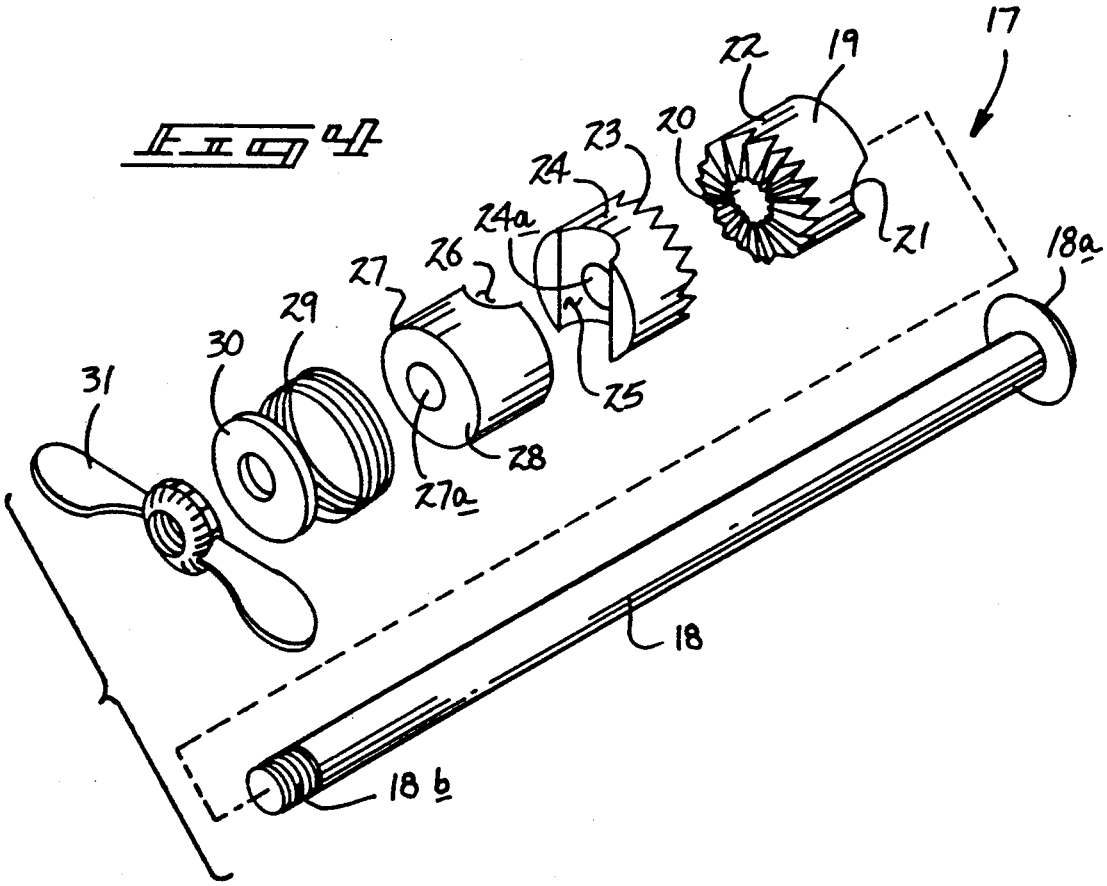

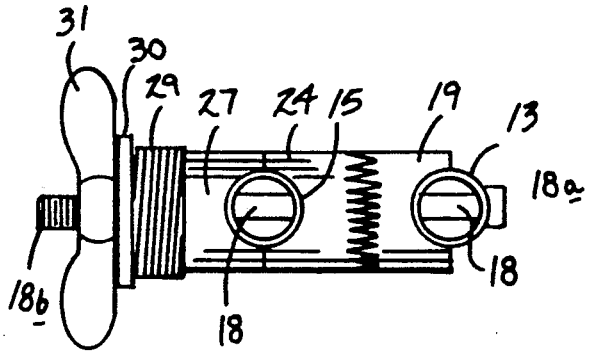
Fig 5
Fig 6
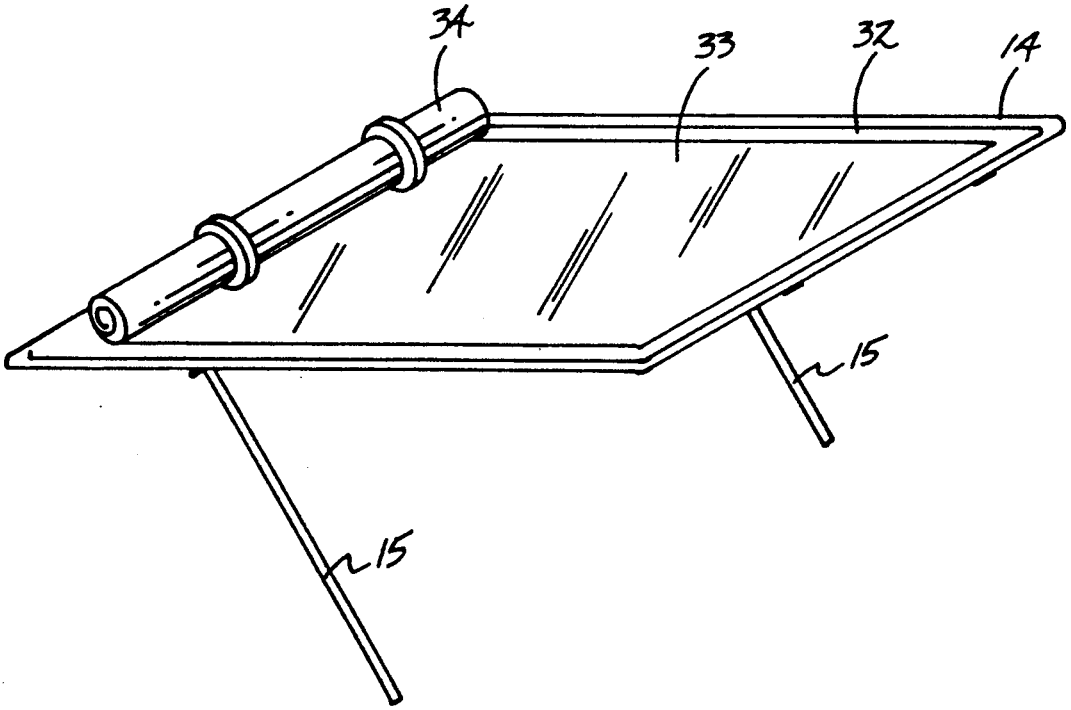

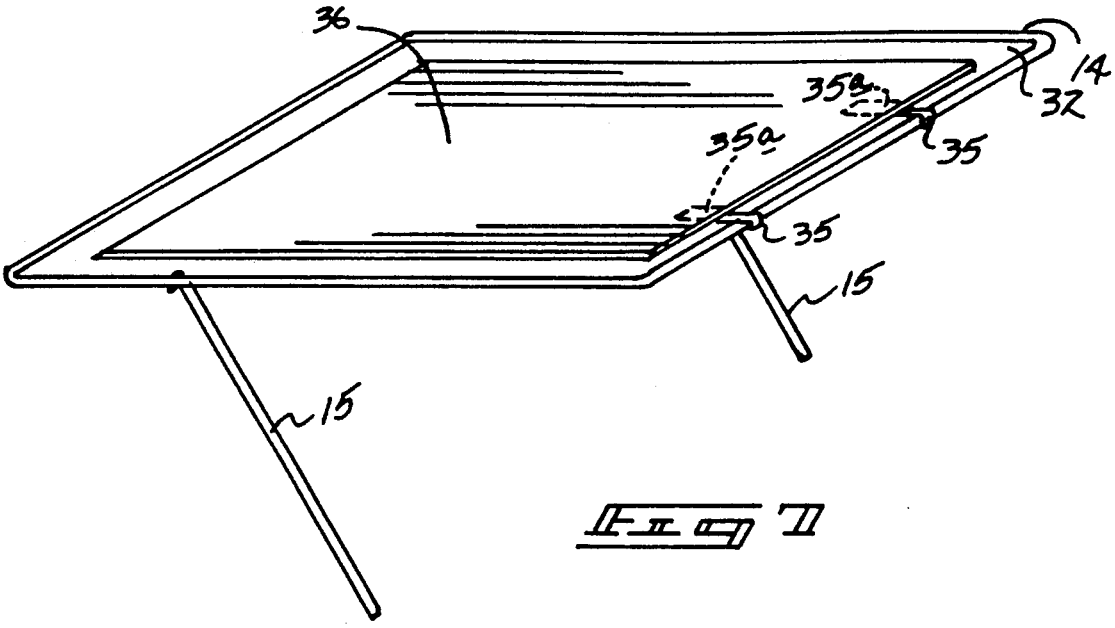
Fig 7
Fig 8
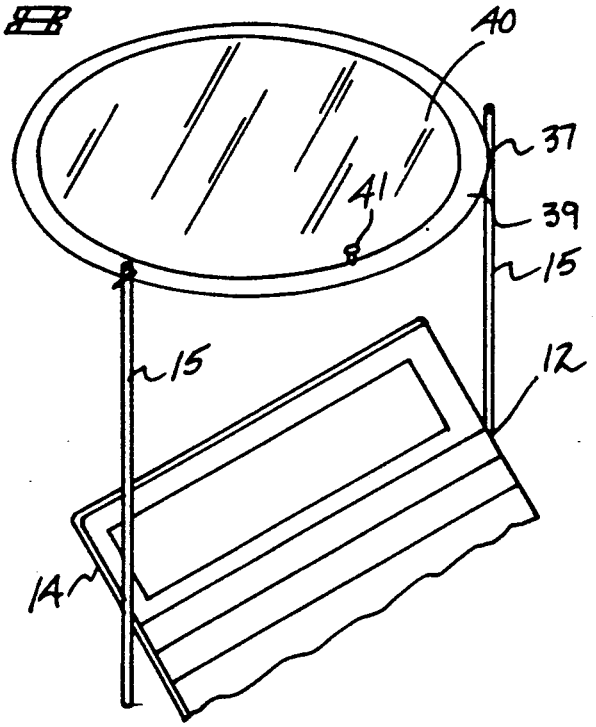
Fig 9
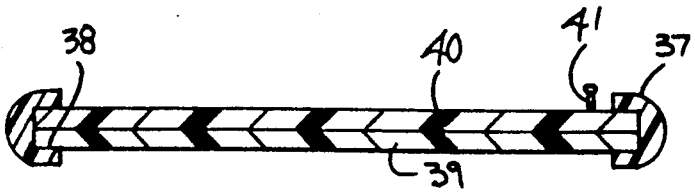

LOUNGE CHAIR CANOPY CONSTRUCTION

BACKGROUND OF THE INVENTION

1. Field of the Invention

The field of invention relates to lounge chair canopies, and more particularly pertains to a new and improved lounge chair canopy construction wherein the same utilizes an overlying adjustable canopy to afford varying shade conditions to an underlying lounge chair.

2. Description of the Prior Art

The use of canopies in combination with lounge chairs is well known in the prior art. Heretofore, the organizations have been of a relatively awkward construction and use and have failed to provide the variable shading afforded by the instant invention. For example, U.S. Pat. No. 4,230,363 to Borichevsky provides a canopy clampingly mounted to an arcuately and rearwardly depending framework of a lounge chair to afford shade for an occupant thereof.

U.S. Pat. No. 4,201,416 to Vanderminden sets forth a "U" shaped clamp construction to secure a canopy to a rearwardly depending framework of a lounge chair, wherein each clamp is formed of a one-piece metal blank configured to fit over the chair frame.

U.S. Pat. No. 4,300,798 to Musgrove, et al., sets forth a foldable chair utilizing an overlying rigid screen pivotally mounted to a vertical frame rod secured to the framework of the chair.

U.S. Pat. No. 4,635,667 to Harn sets forth a canopy slidably mounted on the chair back framework positionable to any angle by adjustment of an associated tension means.

U.S. Pat. No. 4,687,249 to Mills sets forth an adjustable canopy for a chair which is configured for coupling to a tubular back framework of the chair in a frictional engagement relationship and slidably mounted thereto so the canopy may be set to any desired elevation.

As such, it may be appreciated that there is a continuing need for a new and improved lounge chair canopy construction wherein the same addresses both the problems of ease of adjustment and effectiveness in construction, and in this respect, the present invention substantially fulfills this need.

SUMMARY OF THE INVENTION

In view of the foregoing disadvantages inherent in the known types of canopy constructions now present in the prior art, the present invention provides a lounge chair and canopy construction wherein the same enables vertical rotational adjustment of a canopy overlying an associated chair and further affords varying degrees of shading of the canopy during use. As such, the general purpose of the present invention, which will be described subsequently in greater detail, is to provide a new and improved lounge chair canopy construction which has all the advantages of the prior art canopy constructions and none of the disadvantages.

To attain this, the present invention includes a tubular framework supporting a canopy visor therewithin wherein the visor may be formed of tinted, or more particularly polarized material, to effect shading of an occupant therebelow. The visor further includes a flexible, or alternatively a rigid, screen member that is respectively rollably mounted or secured by hook and loop fasteners to the visor. Alternatively, a plurality of relatively rotatable polarized screens are mounted within the canopy construction to vary the shading afforded by the visor configurations as the polarized screens are mounted for rotation relative to one another. An adjustment clamp enables rotational and vertical adjustment of the canopy in relation to the underlying chair.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciated that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved lounge chair canopy construction which may be easily and efficiently manufactured and marketed.

It is a further object of the present invention to provide a new and improved lounge chair canopy construction which is of a durable and reliable construction.

An even further object of the present invention is to provide a new and improved lounge chair canopy construction which is susceptible of a low cost of manufacture with regard to both materials and labor, and which accordingly is then susceptible of low prices of sale to the consuming public, thereby making such lounge chair canopy constructions economically available to the buying public.

Still yet another object of the present invention is to provide a new and improved lounge chair canopy construction which provides in the apparatuses and methods of the prior art some of the advantages thereof, while simultaneously overcoming some of the disadvantages normally associated therewith.

Still another object of the present invention is to provide a new and improved lounge chair canopy construction wherein the same is oriented for multiple adjustment and angulation relative to an underlying chair with a visor construction affording varying degrees of screening to an occupant therebelow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of section 3 of FIGS. 1 or 2 illustrating the adjustment clamp of the instant invention.

FIG. 4 is an isometric exploded illustration of the adjustment clamp of the instant invention.

FIG. 5 is a top orthographic view of the adjustment clamp of the instant invention.

FIG. 6 is an isometric illustration of the canopy construction with a flexible cover arranged thereover.

FIG. 7 is an isometric illustration of the canopy construction with a rigid cover mountable thereto.

FIG. 8 is an alternative embodiment of the canopy construction with a first fixed polarized sun screen underlying an overlying rotatably mounted second polarized sun screen.

FIG. 9 is an orthographic cross-sectional view of the canopy construction of FIG. 8.

DESCRIPTION OF THE PREFERRED EMBODIMENT

Figure 1:
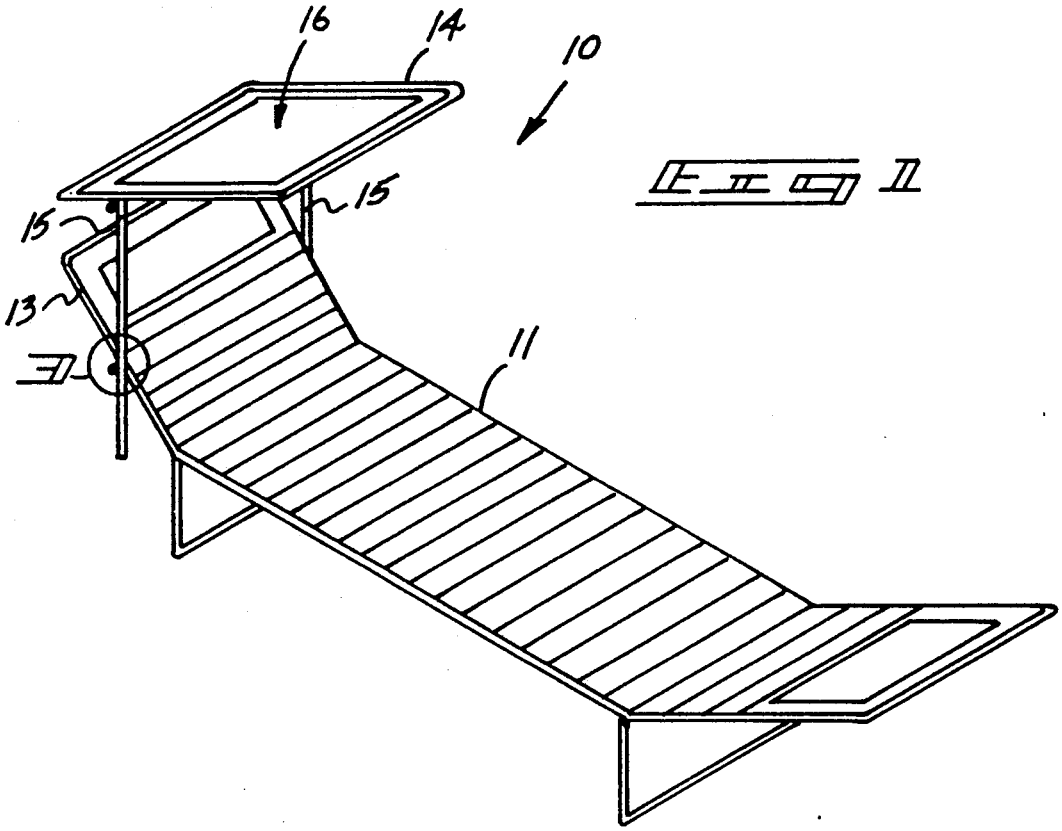
FIG. 1 is an isometric illustration of the instant invention secured to a chaise lounge.

With reference now to the drawings, and in particular to FIGS. 1 to 9 thereof, a new and improved lounge chair canopy construction embodying the principles and concepts of the present invention and generally designated by the reference numeral 10 will be described.

Figure 2:
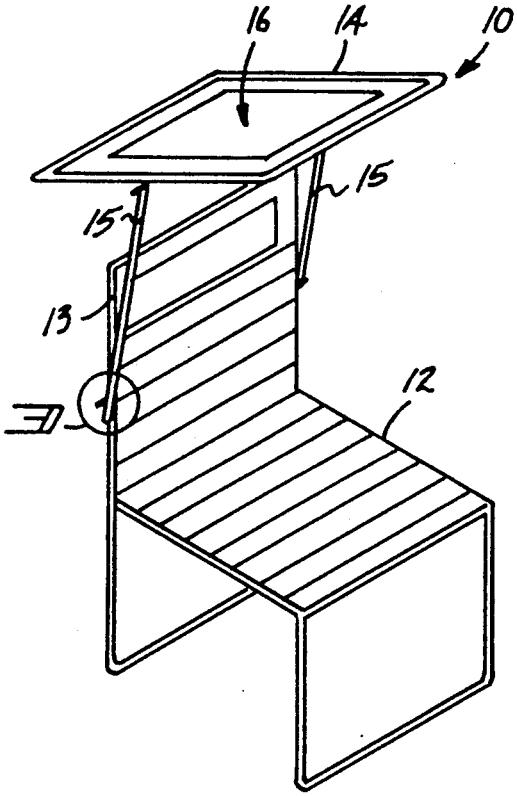
FIG. 2 is an isometric illustration of the instant invention secured to a typical lounge chair.

More specifically, the lounge chair canopy construction 10 essentially comprises a lounge chair 11, as illustrated in FIG. 1, or a typical chair 12, as illustrated in FIG. 2, secured to the overlying canopy construction. The chairs 11 and 12 include tubular chair frameworks 13 with the canopy construction including a tubular canopy framework 14 of a generally rectangular configuration. The tubular canopy framework 14 includes a plurality of vertical tubular support arms 15 fixedly mounted to each side of the canopy framework 14 and extending downwardly therefrom in an orthogonal relationship relative to the framework 14. Mounted within the framework 14 is a canopy sun screen 16 formed as a translucent visor, to be discussed in more detail below. An adjustment clamp 17, as illustrated in FIG. 3, secures the support arms 15 in an adjustable manner relative to the chair framework 13.

The adjustment clamp 17 enables rotary and vertical positioning of the canopy in relation to the underlying chair and includes an elongate bolt 18 formed with an enlarged head 18*a* at one end and a threaded shank 18*b* at the remote end. The bolt 18 extends through a through-extending aperture within the chair framework 13 and is received within a first axial bore 20 of a first cylindrical connector block 19. The first cylindrical connector block 19 includes a first semi-cylindrical recess 21 on a rear face thereof for receiving the tubular chair framework 13 therewithin with a first set of radial serrations 22 integrally formed on a forward face of the first connector block 19. The forward and rear faces of the connector block are arranged orthogonally relative to the axial bore 20, as is the case with the remaining cylindrical blocks to be discussed. The first radial serrations 22 cooperate with second radial serrations 23 formed on a rear face of a second cylindrical connector block 24 formed with a coaxial bore 24*a* and a second semi-cylindrical recess 25 formed on a forward face of the second connector block 24. The second semi-cylindrical recess 25 frictionally receives a vertical tubular support arm 15 therethrough and cooperates with a third semi-cylindrical recess 26 formed on a rear face of a third cylindrical connector block 27 to clamp the support arm 15 therewithin. A planar forward face 28 of the third cylindrical connector block 27 is also mounted orthogonally relative to the third coaxial bore 27*a* of the third cylindrical connector block wherein the axial bores 20, 24*a*, and 27*a* are coaxially aligned relative to one another with the cylindrical connector blocks 19, 24, and 17 of an equal diameter. A coil lock spring 29 cooperates with the planar forward face 28 with a washer 30 formed with a central washer bore to receive the elongate bolt therethrough and enable an internally threaded wing nut 31 to threadedly engage the threaded shank portion 18*b* when the bolt 18 is directed through the aligned axial bores of the connector blocks and washer to simultaneously clamp the tubular chair framework 13 and the support arms 15 therewithin. Upon loosening of the wing nut 31, the support arms 15 may be rotatably adjusted by rotational adjustment of the first and second respective radial serrations 22 and 23 relative to one another wherein manual repositioning and displacement of the support arms 15 against tension of the associated lock springs will effect displacement of the radial serrations 22 and 23 relative to each other to enable such repositioning of the support arms relative to the framework 13.

FIG. 6 illustrates the canopy construction utilizing a polarized transparent sun screen 32 with an opaque flexible cover 33 that is mounted about a cylindrical rolling mandrel 34 to enable the flexible cover 33 to be extended or retracted, as desired, to a predetermined length overlying the sun screen 32. The forward edge of the flexible cover 33 may be secured to the sun screen 32 as desired.

FIG. 7 is illustrative of the polarized transparent sun screen 32 with an opaque rigid cover 36 selectively mounted thereon to effect a blocking of the suns rays with first hook and loop fastener pairs 35 formed as strips orthogonally directed from the canopy framework 14 underlying the opaque rigid cover formed with further hook and loop fasteners 35*a* to secure the cover 36 thereon.

FIG. 8 is illustrative of a modified canopy construction utilizing a "U" shaped annular frame 37 formed with an interiorly directed "U" shaped channel 38 to receive a first fixed annular polarized lens 39 within a bottom surface of the "U" shaped channel 38 and a second polarized lens 40 rotatably mounted overlying the first lens 39 with a handle 41 directed orthogonally from an upper surface of the second lens 40 to enable rotation of the second lens 40 relative to the first lens 39 and thereby vary the relative shading afforded to an occupant positioned underlying the canopy within the chair 12.

As to manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lounge chair canopy construction comprising, a chair including a chair tubular framework, and a canopy overlying the chair framework including a canopy framework with a translucent visor member integrally secured interiorly of and coextensive with the canopy framework, and spaced tubular framework arms integrally secured to the canopy framework extending downwardly therefrom with proximate upper ends of the arms secured to the canopy framework, and adjustable clamp means mounting the arms to the chair framework proximate lower ends of the arms, and the clamp means clamping each arm of the chair framework wherein the clamp means include a plurality of coaxially aligned clamp members to receive a respective chair framework and a respective arm therein, and wherein the clamp members include a first cylindrical connector block including a first semi-cylindrical recess formed in a rear face thereof, and first serrations formed on a forward face thereof, and a second cylindrical connector block formed with second serrations cooperating with the first serrations, and the second cylindrical connector block including a second semi-cylindrical recess formed on a forward face thereof, and a third cylindrical connector block formed with a third semi-cylindrical recess formed on a rear face thereof, the second and third semi-cylindrical recesses clamping a canopy arm therebetween, and the first semi-cylindrical recess configured for receiving a portion of the chair framework therewithin, and an elongate bolt directed through the chair framework and coaxially through each of the first, second, and third cylindrical connector blocks with a coil lock spring coaxially aligned with a forward face of the third cylindrical connector block, and a washer formed with a central bore overlying the coil spring, and a wing nut threadedly secured to a forward distal end of the elongate bolt to clamp the chair framework and the canopy arm within the connector blocks, and the elongate bolt including an enlarged head to secure the chair framework to the first cylindrical connector block.

2. The lounge chair canopy construction as set forth in claim 1 wherein the translucent visor member is formed of a polarized material.

3. The lounge chair canopy construction as set forth in claim 2 wherein the visor member includes an angular "U" shaped framework with an interiorly formed "U" shaped channel formed within the "U" shaped framework, and a first fixed annular polarized lens fixedly secured within a lowermost portion of the "U" shaped channel, and an overlying second polarized lens rotatably mounted within an upper portion of the "U" shaped channel overlying and in contact with the first polarized lens, and wherein the second polarized lens is rotatably mounted relative to the first polarized lens to effect relative shading of an occupant positioned underlying the canopy, and a handle integrally secured to an upper surface of the second polarized lens to enable manual rotation of the second polarized lens relative to the first polarized lens.

* * * * *